US012799736B2

(12) United States Patent
Wee

(10) Patent No.: US 12,799,736 B2
(45) Date of Patent: Nov. 17, 2026

(54) ROOF ELEMENT AND A SHELTER MADE FROM SAME

(71) Applicant: Wee.no AS, Førresfjorden (NO)

(72) Inventor: Rune Wee, Førresfjorden (NO)

(73) Assignee: Wee.no AS, Førresfjorden (NO)

( * ) Notice: Subject to any disclaimer, the term of this patent is extended or adjusted under 35 U.S.C. 154(b) by 52 days.

(21) Appl. No.: 18/873,035

(22) PCT Filed: Jul. 6, 2023

(86) PCT No.: PCT/NO2023/060013

§ 371 (c)(1),
(2) Date: Dec. 9, 2024

(87) PCT Pub. No.: WO2024/025420

PCT Pub. Date: Feb. 1, 2024

(65) Prior Publication Data

US 2025/0305285 A1 Oct. 2, 2025

(30) Foreign Application Priority Data

Jul. 25, 2022 (NO) ..... 20220822
May 11, 2023 (NO) ..... 20230558

(51) Int. Cl.
*E04B 7/20* (2006.01)
*B65D 88/12* (2006.01)
(Continued)

(52) U.S. Cl.
CPC ..... *E04B 7/20* (2013.01); *B65D 88/121* (2013.01); *B65D 90/0006* (2013.01); *B65D 90/0026* (2013.01); *E04B 7/163* (2013.01)

(58) Field of Classification Search
CPC ..... E04B 7/20; E04B 7/163; E04B 1/3483; E04B 7/10; E04B 7/16; E04B 7/24;
(Continued)

(56) References Cited

U.S. PATENT DOCUMENTS 3,363,803 A * 1/1968 Abolins ..... B65D 90/0026 410/82
3,404,444 A * 10/1968 Isbrandtsen ..... B65D 90/0026 29/897
(Continued)

FOREIGN PATENT DOCUMENTS

DE 19501423 A1 7/1996
GB 2078680 A 1/1982
(Continued)

OTHER PUBLICATIONS

Search Report for Norwegian Patent Application No. 20230558, dated Dec. 11, 2023.
(Continued)

*Primary Examiner* — Brent W Herring
(74) *Attorney, Agent, or Firm* — Andrus Intellectual Property Law, LLP

(57) ABSTRACT

A roof element and a shelter having at least one roof element. The roof element is made from a roof element resembling a roof of an ISO freight container. The roof element includes a first face for, in a position of use, forming a downwardly facing surface of the roof element; a second face opposite the first face; and four hexagonal corner portions, wherein each of the four hexagonal corner portions has a first aperture configured for receiving a twistlock element. The first aperture is arranged in a support face of the hexagonal corner portion, the support face being closer to the first face than the second face of the roof element.

15 Claims, 8 Drawing Sheets

(51) Int. Cl.
*B65D 90/00* (2006.01)
*E04B 7/16* (2006.01)

(58) Field of Classification Search
CPC .... E04B 1/34321; E04B 1/344; E04B 1/3447; E04B 2001/34884; E04H 1/1222; E04H 2001/1283; B65D 90/0006; B65D 90/0026; B65D 88/121
See application file for complete search history.

(56) References Cited

U.S. PATENT DOCUMENTS

| | | | | | |
|---|---|---|---|---|---|
| 3,456,829 | A * | 7/1969 | Glassmeyer | B65D 90/0026 | 220/4.01 |
| 3,553,823 | A * | 1/1971 | Alfredsson | B65D 90/0026 | 228/173.6 |
| 3,973,684 | A * | 8/1976 | Di Martino | B65D 90/0006 | 24/287 |
| 4,049,149 | A * | 9/1977 | Durenec | B60P 7/132 | 410/82 |
| 4,591,307 | A * | 5/1986 | Clive-Smith | B60P 7/132 | 24/DIG. 54 |
| 4,705,140 | A * | 11/1987 | Dudley | A62B 1/02 | 182/113 |
| 5,966,956 | A * | 10/1999 | Morris | E04B 1/3444 | 52/79.5 |
| 6,237,794 | B1 * | 5/2001 | Fenton | B65D 90/0026 | 220/1.5 |
| 6,338,513 | B1 * | 1/2002 | Williams | B65D 90/0033 | 294/68.1 |
| 6,729,098 | B1 * | 5/2004 | Brennan, Jr. | B65D 90/0026 | 410/35 |
| 6,877,939 | B2 * | 4/2005 | Tomkins | B65D 90/0013 | 410/82 |
| 10,689,840 | B2 * | 6/2020 | Bonlin | E04B 1/34317 | |
| 12,221,278 | B2 * | 2/2025 | Ford, III | B60P 7/13 | |
| 2009/0089981 | A1 * | 4/2009 | Davidson | B65D 90/0026 | 220/890 |
| 2009/0217600 | A1 * | 9/2009 | De Azambuja | B65D 90/0006 | 52/79.5 |
| 2014/0341701 | A1 | 11/2014 | Sain | | |
| 2016/0281758 | A1 * | 9/2016 | Dagenais | F16B 35/06 | |
| 2019/0153720 | A1 * | 5/2019 | Bonlin | E04B 1/34317 | |
| 2019/0329972 | A1 * | 10/2019 | Vancampen | B65D 90/0026 | |
| 2021/0047107 | A1 * | 2/2021 | Wang | B65D 90/0026 | |
| 2022/0097956 | A1 * | 3/2022 | Blackmon | B66F 5/02 | |

FOREIGN PATENT DOCUMENTS

| | | | | |
|---|---|---|---|---|
| GB | 2131772 | A | 6/1984 | |
| WO | 2014078903 | A1 | 5/2014 | |
| WO | WO-2017019638 | A1 * | 2/2017 | E04B 1/3483 |
| WO | 2017185125 | A1 | 11/2017 | |
| WO | 2021161001 | A1 | 8/2021 | |

OTHER PUBLICATIONS

International Search Report and the Written Opinion for PCT/NO2023/060013, dated Sep. 29, 2023.
Response to the Written Opinion for PCT/NO2023/060013, dated Mar. 18, 2024.
Second Written Opinion for PCT/NO2023/060013, dated Oct. 22, 2024.
International Preliminary Report on Patentability for PCT/NO2023/060013, dated Oct. 21, 2024.
Extended European Search Report for EP Application No. 23847062.9, dated Jun. 19, 2026.

* cited by examiner

ROOF ELEMENT AND A SHELTER MADE FROM SAME

CROSS-REFERENCE TO RELATED APPLICATIONS

This application is the U.S. national stage application of International Application No. PCT/NO2023/060013, filed Jul. 6, 2023, which international application was published on Feb. 1, 2024, as WO 2024/025420 in the English language. The International Application claims priority to Norwegian patents application Nos. 20220822, filed Jul. 25, 2022 and 20230558, filed May 11, 2023. The international application and Norwegian applications are all incorporated herein by reference, in their entirety.

FIELD

The invention relates to a roof element and a shelter made from at least one such roof element. More specifically, the roof element is a roof element made from a roof element resembling a roof of an ISO freight container.

BACKGROUND

With increasing world trade and increasing online trade, the need for flexible and robust warehousing solutions increases.

Today, goods are mostly stored in large warehouses. When the storage need exceeds the storage capacity in the warehouses, you often end up having to store parts of the goods outdoors. Tarpaulins can be used to make sure the goods are kept dry, and in some cases, temporary shelters such as marquees are set up.

Marquees are often expensive and time-consuming to erect. There is therefore a need for alternative temporary roof structures that is capable of carrying external loads from for example snow, which is easy to transport, that can be quickly erected, is suitable for re-use, is durable, and assembled from standard components commercially available.

Publication U.S. Pat. No. 10,689,840 B2 discloses a building structure assembly that includes standardized interlocking components sized to suit any particular size of building required and ISO standard shipping containers, including: at least one modular base structure, at least one modular beam structure, and at least one wall support in the form of a shipping container and a method of assembly of the building structure. Each modular beam and base structures a frame, interlocking with each other and a shipping container by corner castings with twist lock assemblies. The modular beam structures can function as roof trusses and are sized to be transported inside shipping containers. To provide an exterior roofing layer, the roof support is covered with any suitable covering after the roof support has been formed.

Publication WO2014078903 A1 discloses a shipping container roof structure including a unitary roof shell with at least one flange portion depending therefrom to at least abut a portion of a shipping container to position the roof shell thereon. The roof structure is provided with abutment blocks, wherein each abutment block comprises attachment mechanisms in the form of a protruding twistlock configured for engaging an ISO corner casting fitted to a shipping container.

SUMMARY

The invention has for its object to remedy or to reduce at least one of the drawbacks of the prior art, or at least provide a useful alternative to prior art.

The object is achieved through features, which are specified in the description below and in the claims that follow.

According to a first aspect of the invention, there is provided a roof element made from a roof element resembling a roof of an ISO freight container, the roof element comprising:

- a first face for, in a position of use, forming a downwardly facing surface of the roof element;
- a second face opposite the first face; and
- four hexagonal ISO corner portions, wherein each of the four hexagonal ISO corner portions comprises a first aperture configured for receiving a twistlock element. The first aperture is arranged in a support face of the hexagonal ISO corner portion having a thickness being larger than a thickness of the second face, wherein the support face being closer to the first face than the second face of the roof element.

By the term resembling is meant that the roof element commensurate with at least dimensions of a roof of a standard ISO container, and provided with first and second faces, and any insulation therebetween being the same as such a roof. A standard ISO freight or shipping container is available in various lengths, such as for example 10 ft (3.05 m), 20 ft (6.1 m) and 40 ft (12.2 m). The roof element according to the invention is therefore also available in various dimensions. A common type of ISO container has a width of 2.4 m.

The roof element according to the invention is typically rectangular, meaning that the roof element is made from a four-sided polygon that has four right angles and each pair of opposite sides parallel and of the same length. Both pairs of opposite side may in one embodiment be of the same length, thereby forming a quadrate.

A main difference between the roof element according to the invention, and a roof of an ISO container, is that the hexagonal corner portion of the roof element is arranged upside-down as compared with a hexagonal corner portion of an ISO container. Thus, the first aperture of each of hexagonal corner portions forming part of the roof element according to the invention faces downwards or substantially downwards in a position of use, i.e., is closer to the first face than the second face or upper face of the roof element.

One advantage of the first aperture in the hexagonal corner portion, is that the corner portions do not comprise any protrusions extending from the support face thereof. Any risk of damaging the corner portions during transport and handling of the roof element is therefore reduced. A twistlock element can be inserted into the first aperture only if or when needed, depending on a type of support means that are provided for supporting the roof element in a position of use. The support may typically be an ISO fright container, a supporting column, a beam, a trusswork, or combinations thereof.

Preferably, each of the hexagonal corner portions is made from an ISO 1161 corner casting, hereinafter denoted ISO corner casting. This has the advantage that standard, commercially available parts can be used as corner portions of the roof element. An ISO corner casting is further provided with apertures arranged through side portions, i.e., faces being intermediate the first and the second face.

In one embodiment, at least some of the ISO corner portions are provided with a second aperture configured for receiving a twistlock element. The second aperture is arranged in a face of the corner portion being opposite the support face comprising the first aperture. This has the effect that multiple corner portions comprising first and second apertures for engagement with twistlocks may be used to form for example foldable roofs by connecting roof elements by means of hinged brackets arranged in apertures of adjacent roof elements. The second aperture is preferably made in a corner portion of an ISO corner casting. Preferably, the second aperture is arranged coaxially with the first aperture.

An advantage of the first and second apertures being arranged coaxially is that it enables easy and secure stacking of multiple roof elements during transportation, by securing the roof elements to each other by means of double ended twistlocks.

To allow the roof element to be secured to for example a column or a beam as an alternative to or additionally to a twistlock, the support face of at least one of the four ISO corner portions may further comprise at least two threaded bolt holes. In one embodiment, the support face is provided with more than two threaded bolt holes, for example three or four bolt holes. The threaded bolt holes may advantageously be used for rigid fastening of supporting columns to a roof element used as a roof or parts thereof. The threaded bolt holes may also be used to fix brackets for e.g., coupling two roof elements together or attachment of struts.

Since the roof element according to the invention is made from a roof element resembling a roof of an ISO freight container, a distance between corner portions of the roof element may mate with ISO corner portions of an ISO shipping or freight container.

An advantage of providing a distance between corner portions of the roof element so that they mate with ISO corner portions of an ISO container so that both the distances between adjacent first apertures and the distances between second apertures being the same as a distance between twistlock apertures of an ISO container, is that an ISO container may be used to support a roof element to form a shelter according to an aspect of the invention. A stack of roof elements may further be secured to and transported on top of an ISO container by means of double ended twistlocks fastening the lowermost roof element of the stack to the ISO container.

According to a second aspect of the invention there is provided an assembly comprising at least two roof elements hingedly interconnected by hinged brackets. Each hinged bracket may comprise:

- a first hinge portion comprising a twistlock element;
- a second hinge portion comprising a twistlock element;
- wherein the first hinge portion is pivotable with respect to the second hinge portion, and the twistlock elements of the hinged brackets connecting abutting roof elements, may be in engagement with either a first aperture or a second aperture of the corner portions of the roof elements.

According to a third aspect of the invention, there is provided a shelter comprising at least one roof element according to the first aspect of the invention, and a support for carrying the roof element in an elevated position.

The support may be connected to the roof element via the first apertures of the hexagonal ISO corner portions. Thereby, the roof element of the shelter rests on top of the support. However, since the corner portion of the roof element is an ISO corner casting, the roof element may be connected to the support via an aperture arranged in a side portion of the corner casting. Connecting the roof to a support via an aperture arranged in a side portion of the corner casting, has the effect that a top portion, i.e., the second face of the roof element, may be substantially flush with a top portion of a support such as an ISO freight container.

The support of the shelter may be one of or a combination of an ISO freight container, a column, a beam, a truss, or combinations thereof.

The supports and the roof element may be interconnected by means of at least one twistlock element. The twistlock element may be a double ended twistlock.

The support face of at least one of the four corner portions of the roof element of the shelter may further comprise at least two threaded bolt holes, and wherein the support may be connected to the roof element by means of threaded bolts being in engagement with the threaded bolt holes.

The shelter may comprise at least two roof elements hingedly interconnected by hinged brackets. Each hinged bracket may comprise:

- a first hinge portion comprising a twistlock element;
- a second hinge portion comprising a twistlock element;
- wherein the first hinge portion is pivotable with respect to the second hinge portion, and the twistlock elements of the hinged brackets connecting abutting roof elements may be in engagement with either a first aperture or a second aperture of the corner portions of the roof elements of the shelter.

An advantage of using a hinged bracket engaging at least two roof elements is that the roof may be folded and unfolded, like an "accordion roof".

According to a fourth aspect of the invention, there is provided a stack of two or more roof elements according to the first aspect, the stack comprising at least one twistlock element arranged in opposing first and second apertures of two abutting roof elements. The twistlock element may typically be a double ended twistlock.

BRIEF DESCRIPTION OF THE DRAWINGS

There will now be described, by way of examples only, embodiments of the invention, with reference to the accompanying drawings, in which.

DETAILED DESCRIPTION OF THE DRAWINGS

Figure 1A:
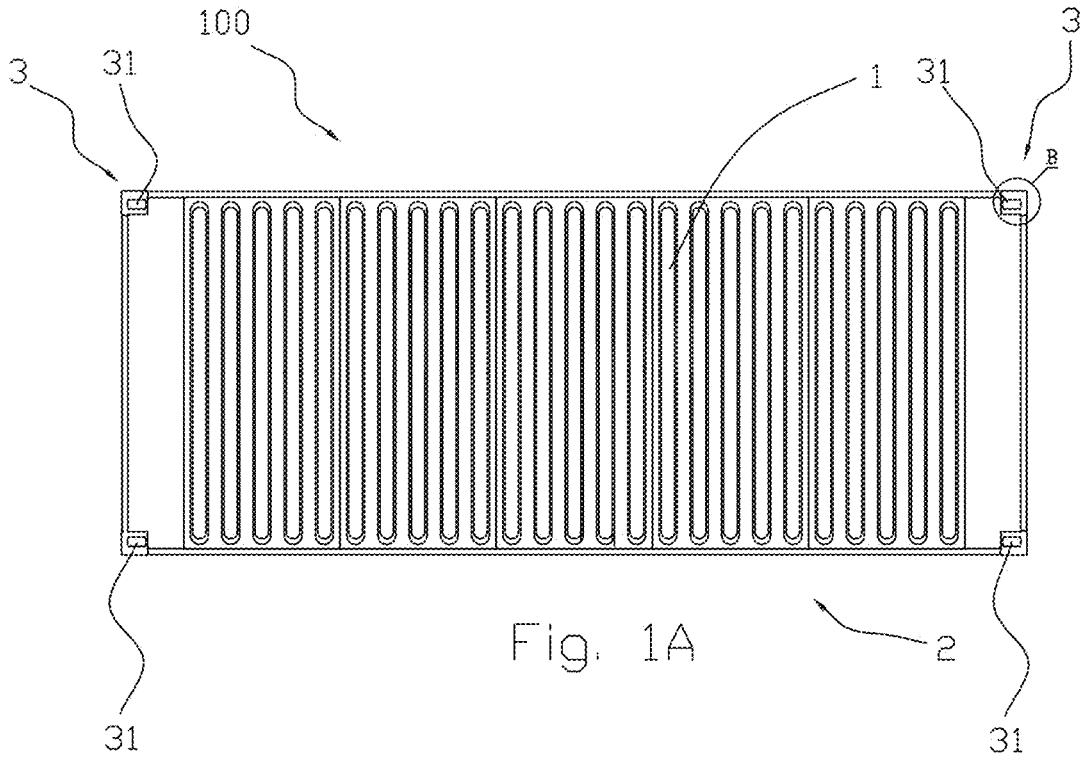
FIG. 1A shows a roof element according to the invention with a first or lower face facing upwards.

Any positional indications refer to the position shown in the figures.

In the figures, same or corresponding elements are indicated by same reference numerals. For clarity reasons, some elements may in some of the figures be without reference numerals.

A person skilled in the art will understand that the figures are just principal drawings. The relative proportions of individual elements may also be distorted.

In the figures, reference numeral 100 denotes a roof element made from a roof element resembling a roof of an ISO freight or container. The roof element 100 comprises a first face 1, a second face 2 opposite the first face, and four corner portions 3. The first face 1 is configured for, in a position of use, forming a downwardly facing surface of the roof element 100. In the description below, the first face 1 will also be denoted the lower face 1 and the second face 2 opposite the first or lower face 1, will also be denoted the upper face 2.

In the embodiments shown, the corner portions 3 have a hexagonal form and are in some of the figures in the form of corner portions 3 modified from ISO 1161 corner castings. The modifications will be discussed below.

Figure 1B:
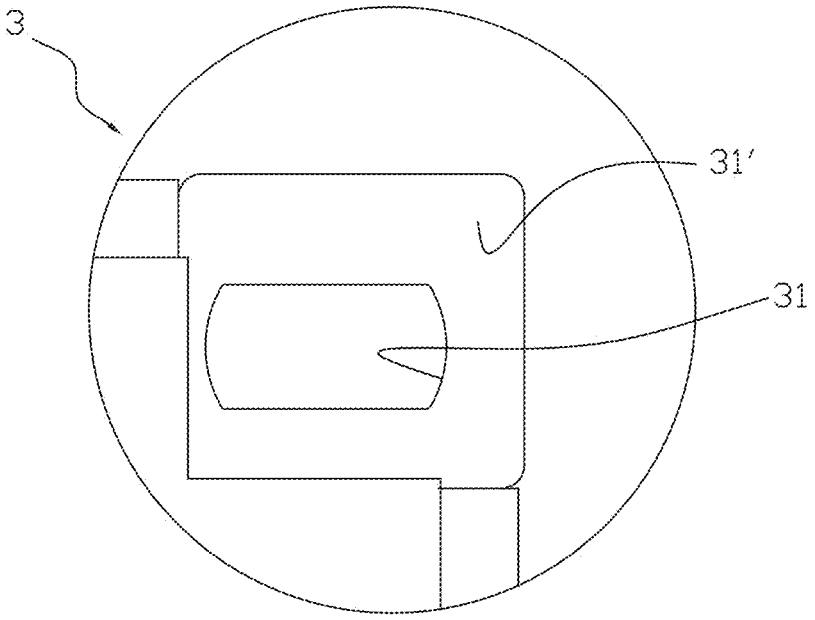
FIG. 1B shows in a larger scale detail B of the upper right corner portion of the roof element in FIG. 1A.

The roof element 100 in FIG. 1A is shown with the lower face 1 facing upwards. The upper face 2 opposite the lower face 1, faces downwards, hence not shown in FIGS. 1A and 1B. Each of the corner portions 3 comprises a first aperture 31 arranged in a support face 31' of the hexagonal corner portion 3. Thus, the support face 31' of the corner portion 3 may be coplanar with at least portions of the lower face 1 of the roof element, i.e., being closer to the first face 1 than the second face 2 of the roof element 100. As best seen in FIG. 1B, the first apertures 31 have a substantially oval shape adapted for engagement with a twistlock. The twistlock may be a twistlock for use with ISO containers (shown in FIG. 6B). The term "ISO container" is used for a container that may comply with the ISO 1161 standard (for corner castings) and for example ISO 668 standard (for series 1 freight container).

Figure 2:
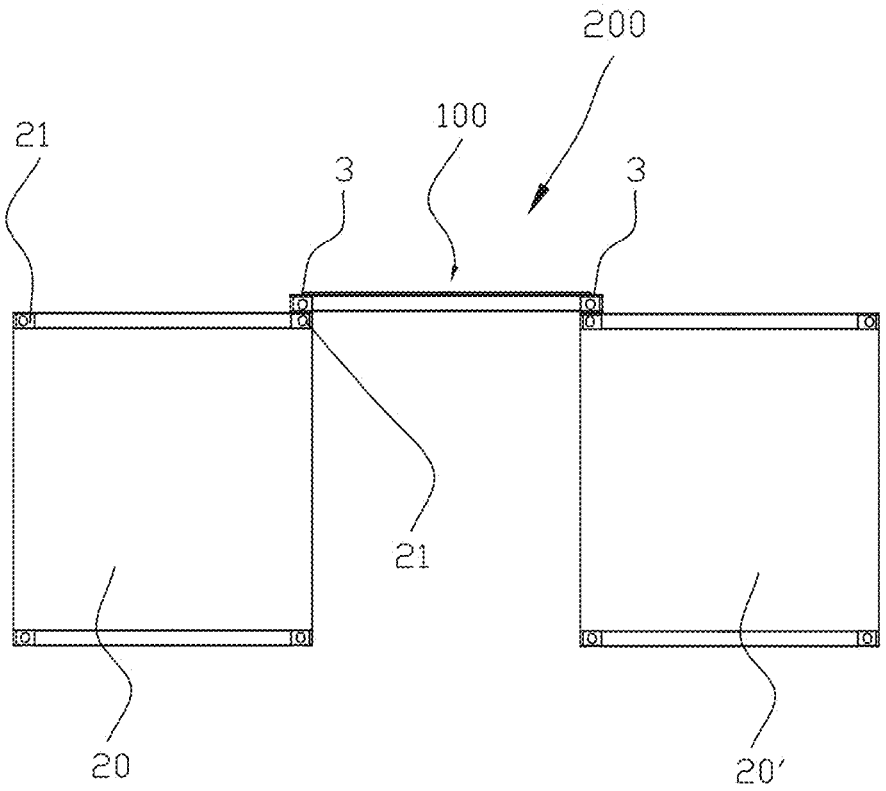
FIG. 2 shows a roof element suspended between two containers.

FIG. 2 shows one example of use of a roof element 100 forming part of a shelter 200. The roof element 100 is suspended between two mutually spaced apart ISO containers 20, 20'. In the embodiment shown in FIG. 2, two corner portions 3 of the roof element 100 are fastened to two corners of the ISO container 20. The other two corner portions 3 of the roof element 100 is fastened to two corners of the other (right) ISO container 20'. The roof element 100 and the containers 20, 20' form the shelter 200. In the embodiment shown, the roof element 100 is fastened to the containers 20, 20' by means of double ended twistlocks 10 (not shown in the figure). An example of a double ended twistlock 10 is shown on FIG. 6B. One double ended twistlock 10 is arranged in each corner portion 3 of the roof element 100. Each double ended twistlock 10 is engaged in the one end through an aperture in an upper face of the ISO corner casting 21 of the containers 20, 20' and in the other end through the first aperture 31 of the support face 31' to the roof element 100.

To ensure compatibility with ISO containers 20, 20', roof element 100 resembles a roof of an ISO freight container so that the lateral extension of the roof element 100 is substantially the same as the lateral extension of an ISO container 20. Similarly, the positions of the first apertures 31 of the corner portion 3 of the roof element 100 equals the positions of corresponding twistlock apertures in the corner castings 21 of the ISO container 20.

Figure 3A:
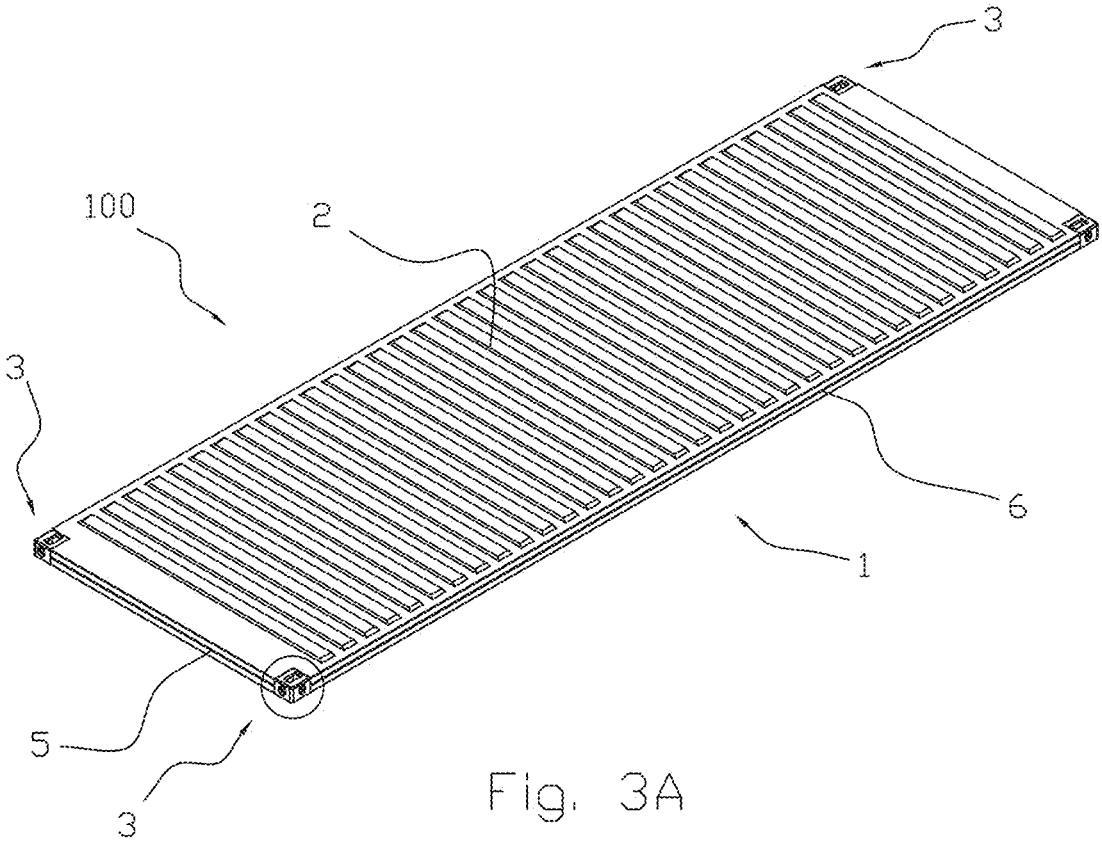
FIG. 3A shows in perspective from above, an embodiment of roof element having corner portions provided with a second aperture opposite a first aperture shown in FIG. 1.
Figure 3B:
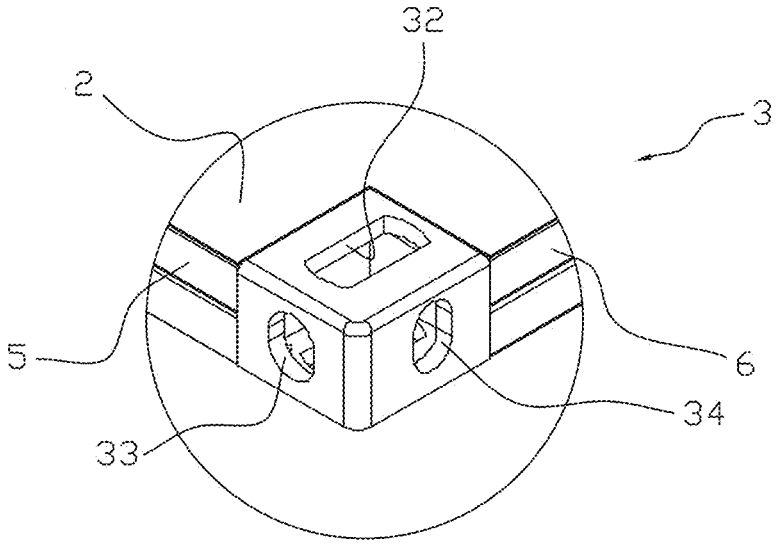
FIG. 3B shows in a larger scale a detail of the lower left corner portion of the roof element in FIG. 3A.

Another embodiment of the roof element 100 is shown in FIGS. 3A and 3B. In FIGS. 3A and 3B the second or upper face 2 is shown facing upwards, as will be a typical position of use of the roof element 100.

The roof element 100 shown i.a. in FIG. 3A, has a rectangular shape (seen from above) with short sides 5 and long sides 6. In the embodiment shown, each of the four corner portions 3 further comprises a second aperture 32 through the upper face 2, see FIG. 3B. Each corner portion 3 further comprises a third aperture 33 through the short side 5 and a fourth aperture 34 through the long side 6. Both the second, third and fourth apertures 32, 33, 34 are adapted for engagement with twistlocks 10 adapted for use with ISO certified containers 20. The third and fourth apertures 33, 34 forms part of an ISO 1161 corner casting. The second aperture 32 are similar to and arranged coaxially with the first apertures 31 in the support face 31' of the corner portion 3. The first aperture 31 forms part of an ISO 1161 corner casting. As can be seen in the FIG. 3B, the third and fourth apertures 33, 34 are smaller than the second apertures 32, hence adapted for engagement with a twistlock 10 of a smaller size.

The second aperture 32 is additional to the first, third and fourth apertures 31, 33, 34 forming part of an ISO 1161 corner casting. In FIGS. 3A and 3B, the second, third and fourth apertures 32, 33, 34 provides apertures being arranged similar to corner casting 21 of an ISO certified container 20. However, since the corner portions 3 are "upside down" as compared with ISO corner castings of a roof of an ISO container, a wall thickness of the corner portion 3 comprising the second aperture 32 is less than a wall thickness of the support face 31' comprising the first aperture 31.

Figure 5A:
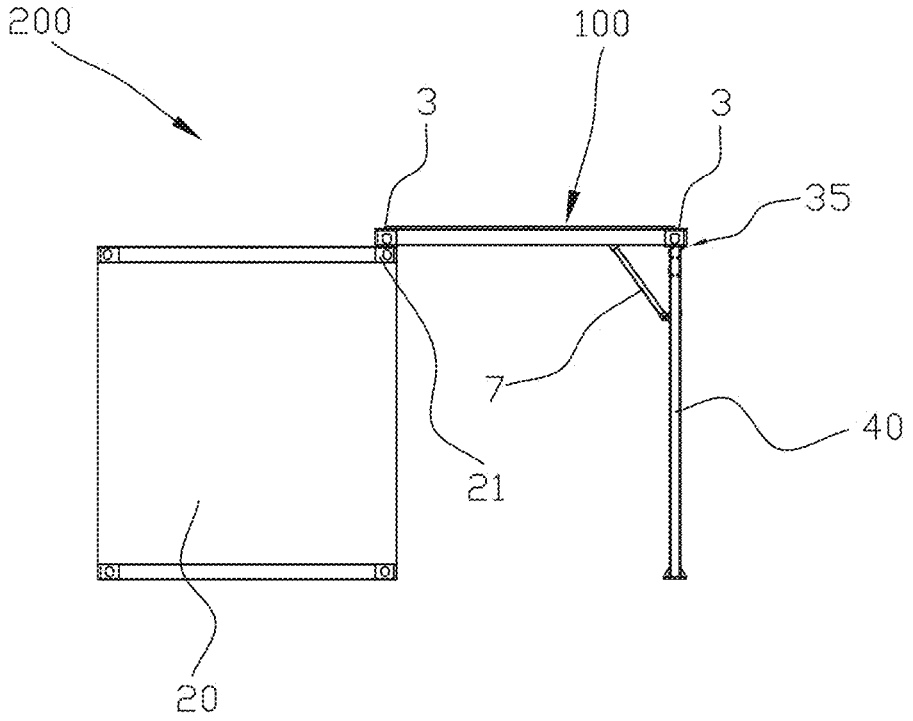
FIG. 5A shows a shelter according to an embodiment of the invention wherein a roof element is suspended between a container and supporting columns.
Figure 5B:
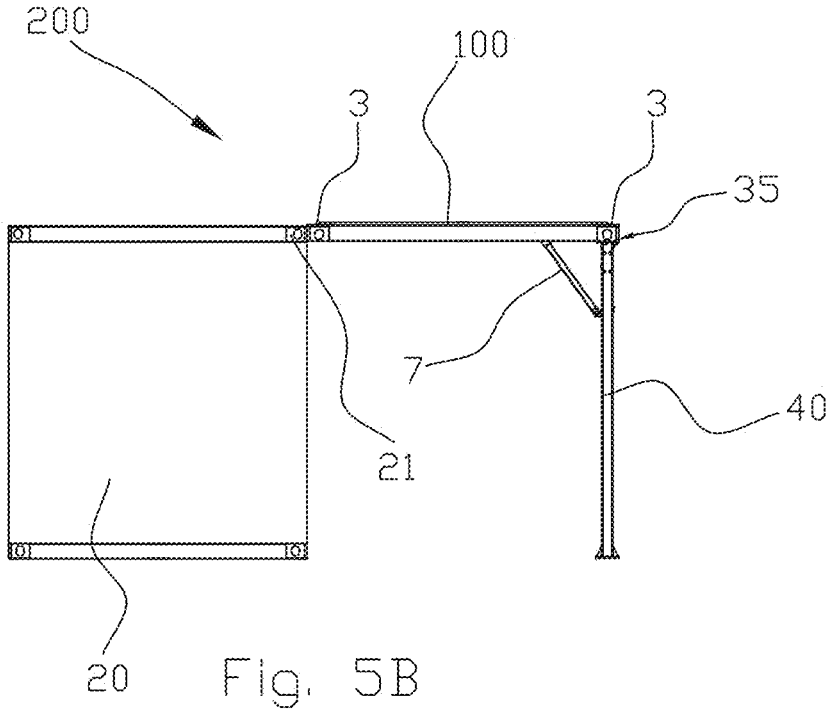
FIG. 5B shows a shelter according to an embodiment of the invention wherein a roof element is suspended between a container and supporting columns.

By means of the first aperture 31 arranged in the support face 31' opposite the face comprising the second aperture 32, a full flexibility for fastening of the roof element 100 to one or more ISO containers 20 are provided, either by use of the first apertures 31 as indicated for example in FIG. 2, by use of the third or fourth apertures 33, 34 as indicated in FIG. 5B. Further, the second aperture 32 may be used for providing a stacking of roof elements 100 for example for transportation, and/or providing a shelter 200 comprising a foldable roof as will be discussed below.

Figure 4:
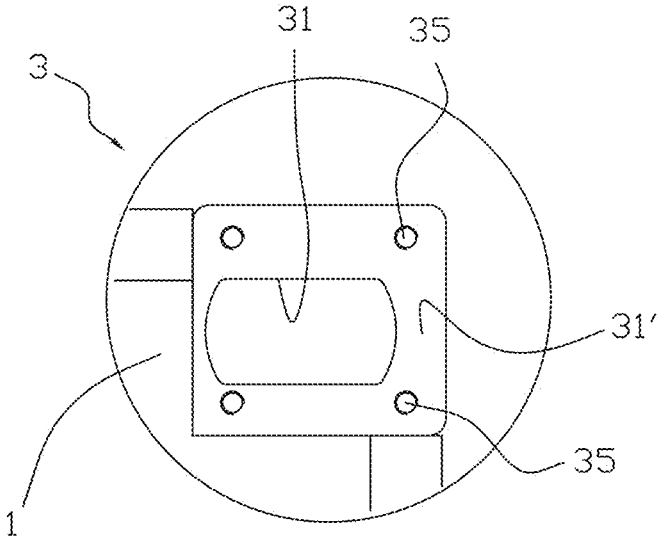
FIG. 4 shows a detail of a corner portion as shown in FIG. 1B further comprising threaded holes arranged in a support face of the corner portion.

FIG. 4 shows a corner portion 3 of the roof element 100 wherein the support face 31' is provided with threaded bolt holes 35 (four shown) for receiving bolts (not shown). The threaded holes 35 provide additional flexibility for supporting the roof element 100 for example on top of supporting columns 40 as shown in FIGS. 5A and 5B.

FIGS. 5A and 5B show shelters 200 comprising a roof element 100 and supports in the form of an ISO container 20 supporting one of the two long sides 6 of the roof element 100, and two supporting columns 40 (only one shown) supporting the other one of the long sides 6 of the roof element 100. In the embodiment shown in FIG. 5A, the roof element 100 is fixed in one end to the ISO container 20 in the same way as for the example of FIG. 2. In FIG. 5A, each supporting column 40 is fixed to the roof element 100 by four bolts arranged in the threaded bolt holes 35 of the corner portion as shown in FIG. 4. Optional support struts 7 is provided to further increase the stability of the roof element 100. The supporting columns 40 may also be fixed by using twistlocks 10 arranged through the first apertures 31 of the roof element 100. In the latter case, the supporting columns 40 must include apertures (not shown) for engagement with the double ended twistlocks 10, or the supporting columns 40 may be provided with a twistlock secured to and protruding from a top portion each supporting column 40.

FIG. 5B shows an embodiment being similar to the embodiment shown in FIG. 5A. However, in FIG. 5B the roof element 100 is secured to the container 20 via the fourth apertures 34 of the corner portions 3, and the supporting columns 40 are shortened correspondingly. In FIG. 5B the roof of the container 20 and the roof 100 of the shelter 200 is substantially coplanar.

Figure 6A:
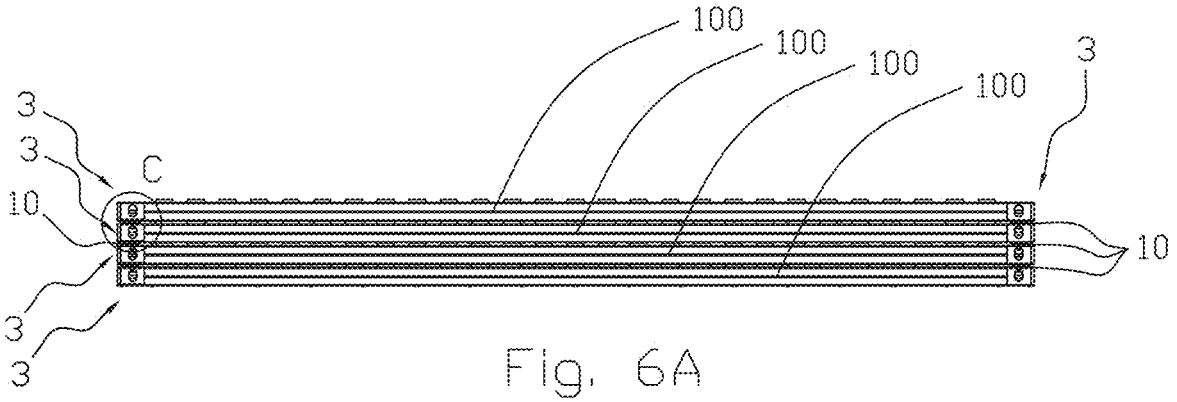
FIG. 6A shows a stack of roof elements.
Figure 6B:
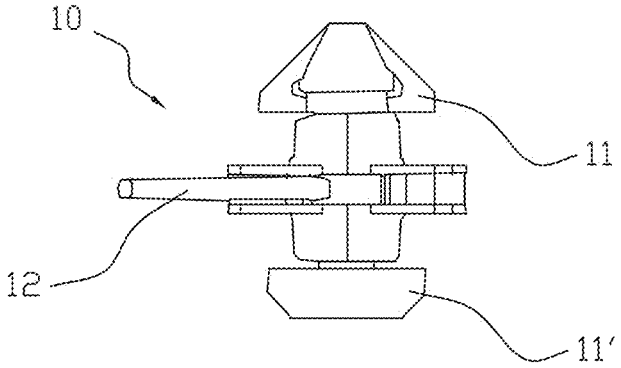
FIG. 6B shows in a larger scale a double ended twistlock.

FIG. 6A shows a plurality (four shown) of roof elements 100 stacked on top of each other, wherein the roof elements 100 comprise first and second apertures 31, 32 in each corner portion 3 of the roof elements 100. The first and second apertures 31, 32 enable easy and safe transportation of the roof elements 100 by interlocking adjacent roof elements 100 by use of double ended twistlocks 10. An example of a double ended twistlock 10 is shown in FIG. 6B comprising two ends 11, 11' for engagement with first and second apertures 31, 32, respectively of two adjacent roof elements 100. The twistlock 10 further comprises a lever 12 for twisting the ends 11, 11', thereby locking or opening the twistlock 10.

Figure 6C:
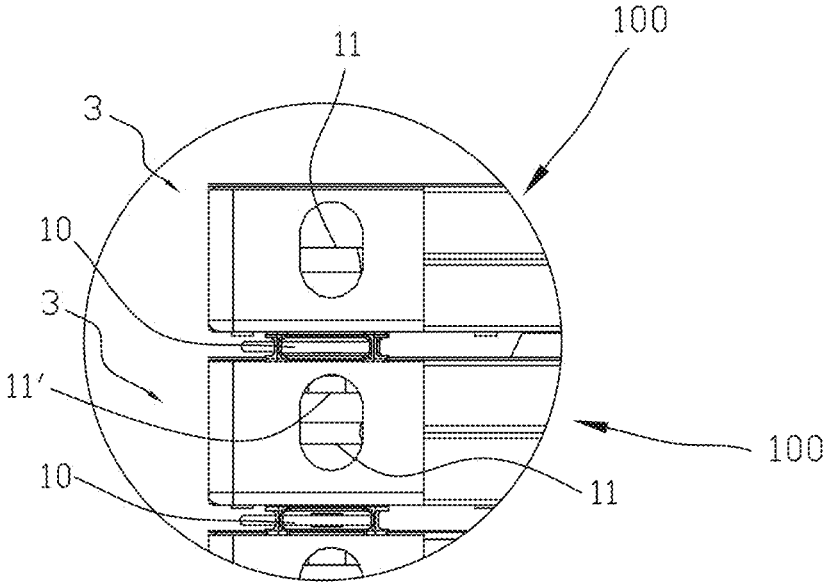
FIG. 6C shows in larger scale detail C in FIG. 6A.

As can be seen in FIG. 6C, a twistlock 10 is arranged between two corner portions 3. The twistlocks 10 are engaged in one end 11 to first apertures 31 and in another end 11' to second apertures 32, thereby interlocking adjacent roof elements 100 to each other. The lowermost roof element 100 of the stack may be fastened by means of a twistlock to a platform of a truck or a train arranged to transport ISO containers. Similarly, a stack of roof elements 100 may be fixed and transported on top of an ISO container by locking the lowermost roof element 100 to the top of the ISO container by means of twistlocks 10.

Figure 7:
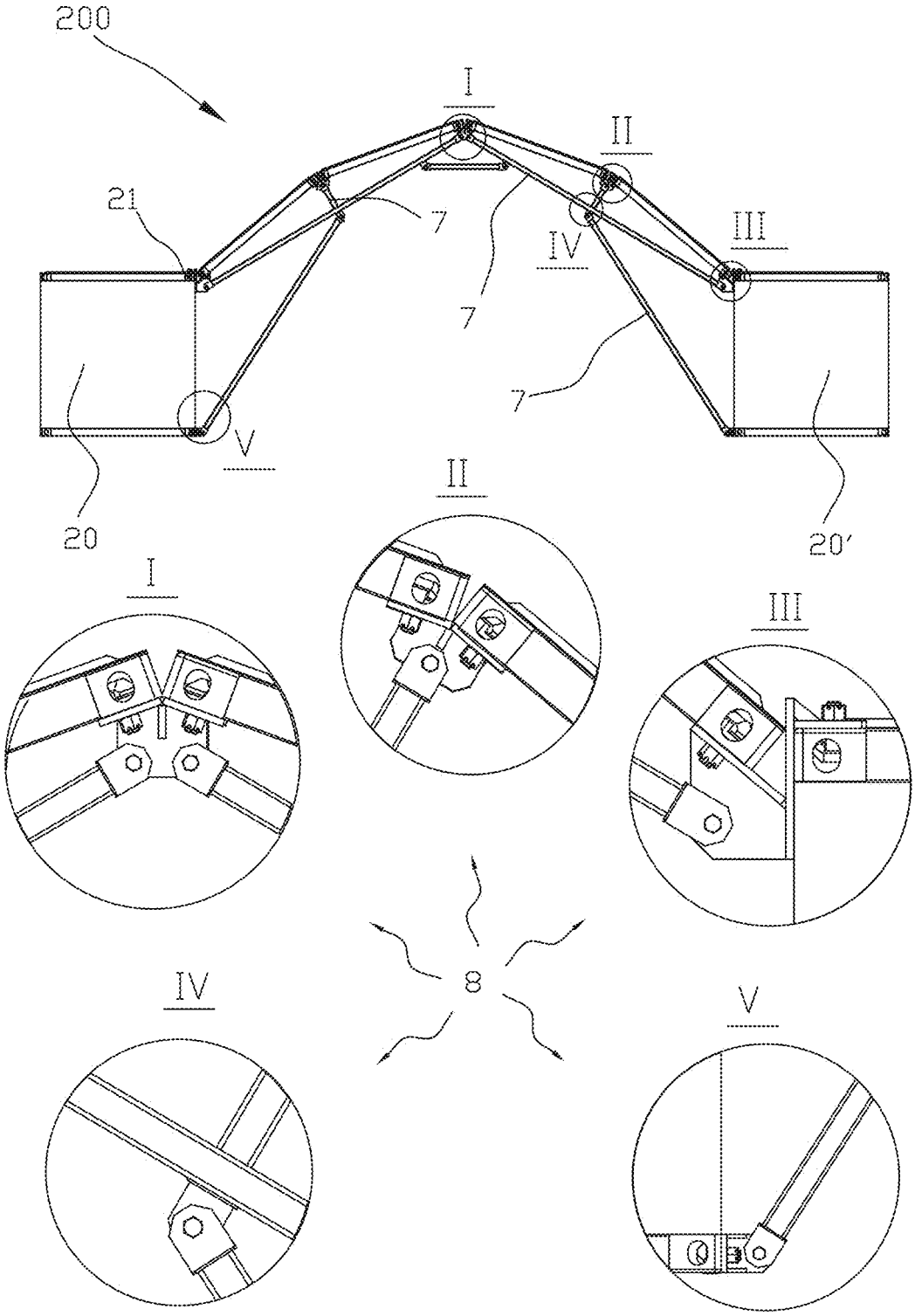
FIG. 7 shows an example of a roof made by roof elements including detailed view of various bracket arrangements.

FIG. 7 shows an embodiment of the present invention wherein four roof elements 100 and a supporting structure 20, 20', 7 provide a shelter 200 for storage of large items, such as for example small airplanes. The four roof elements 100 are fixed to each other along the long sides 6. As shown in the figure, several optional support struts 7 are used to further support the roof elements 100. In the example shown, various brackets 8 are used to join roof elements 100 together and to fasten two outermost roof elements 100 to the ISO containers 20, 20'. The brackets 8 (see I to V in FIG. 7) can be fixed to the roof elements 100 by use of the threaded bolt holes 35 in the corner portion 3 or by use of any of the apertures 31, 32, 33, 34 in the corner portion 3. The struts 7 are fixed to the roof elements 100 via the brackets 8.

Figure 8A:
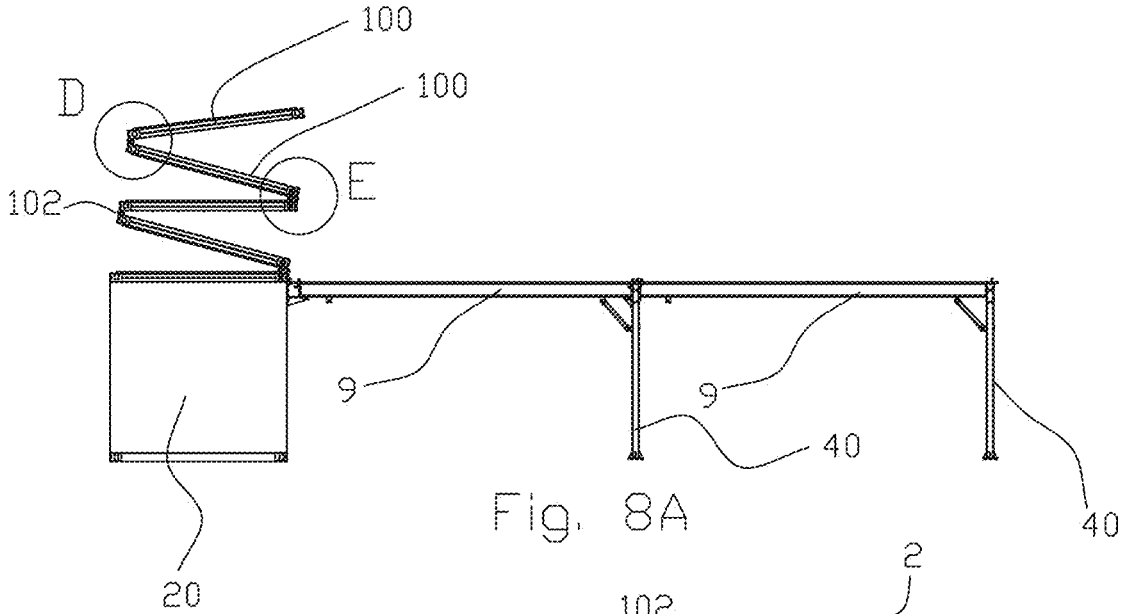
FIGS. 8A to 8C show a sequence of providing a shelter comprising four roof elements that are hingedly interconnected.
Figure 8B:
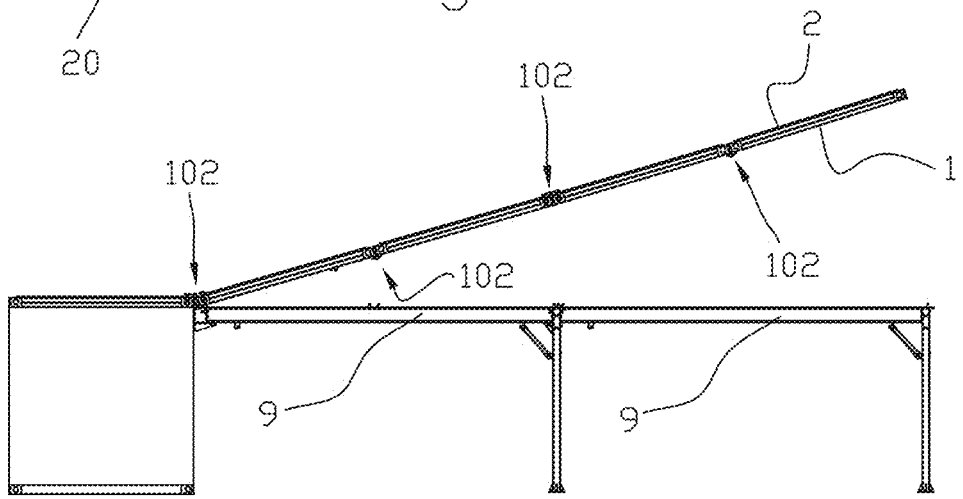
Figure 8C:
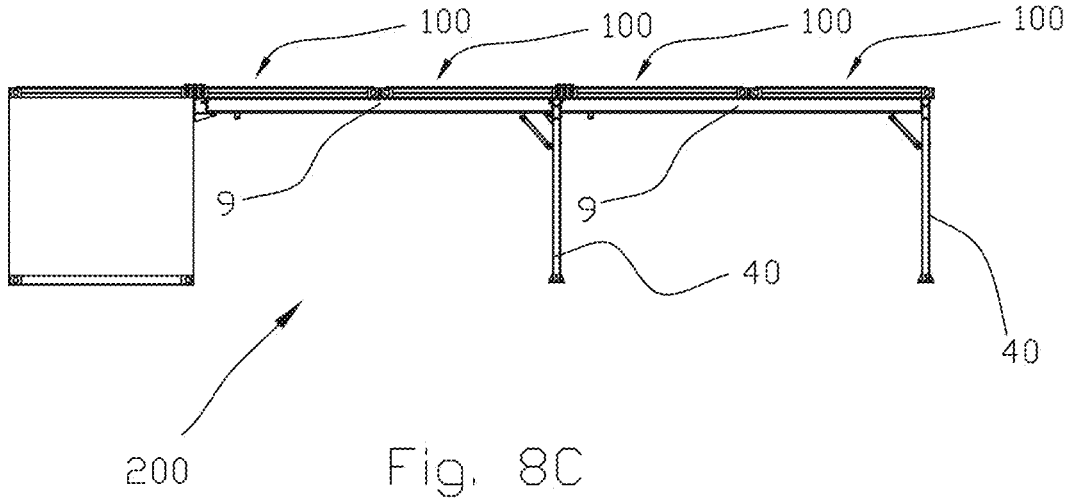

FIGS. 8A to 8C show a configuration of a shelter 200 comprising four roof elements 100 being foldable interconnected. In this configuration, any two roof elements 100 abutting each other are connected to each other along the long sides 6. Hinged brackets 102 are used to connect two adjacent roof elements 100 together. Adjacent brackets 102 are arranged alternatingly in the second apertures 32 of the second face 2 and in the first apertures 31 of the first face 1 of roof elements 100 as best seen of FIGS. 8D and 8E, respectively, to provide the foldable configuration.

Figure 8D:
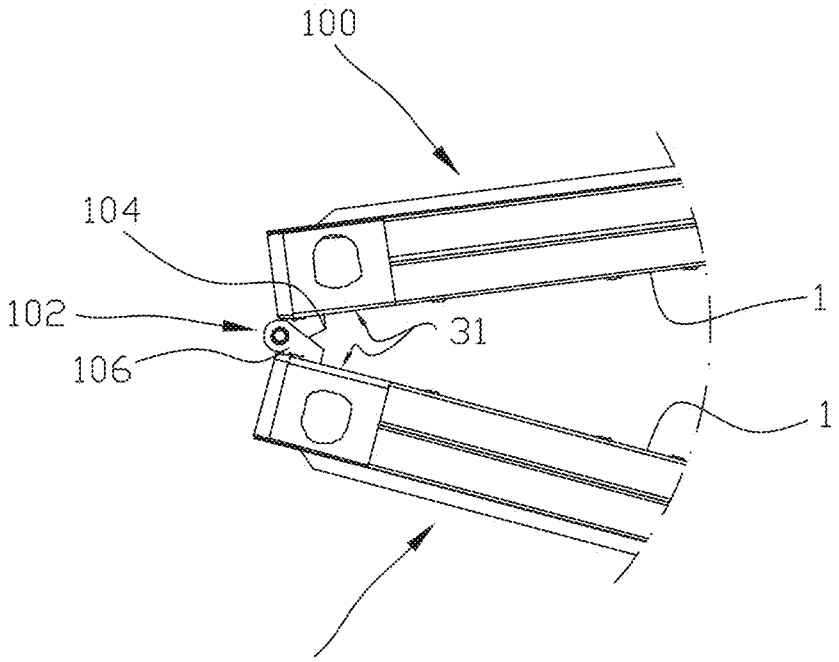
FIGS. 8D and 8E show in larger scale details D and E, respectively, in FIG. 8A.
Figure 8E:
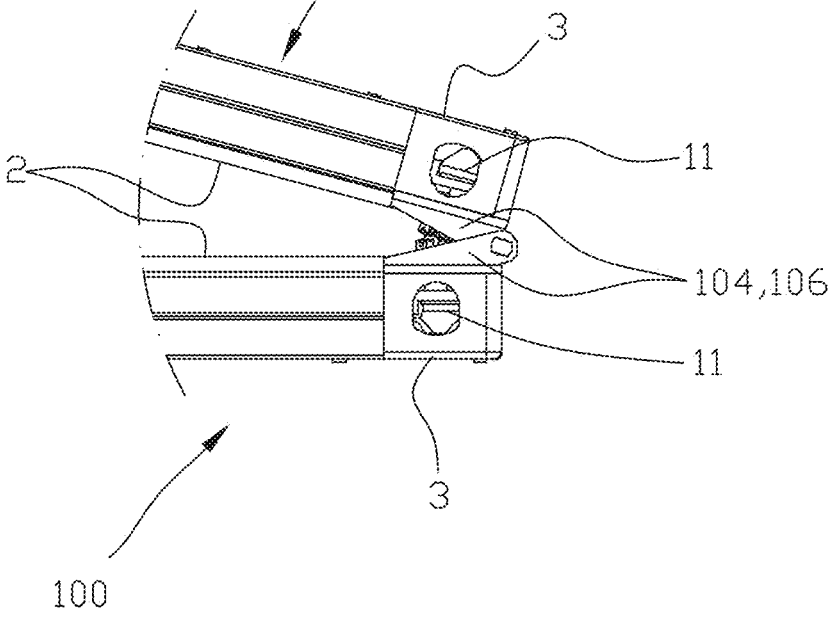

In FIG. 8D, the twist lock elements (not shown) connected to each one of hinge portions 104, 106 of the bracket 102, have been inserted through the first apertures 31 of the corner portions 3 of adjacent roof elements 100, while in FIG. 8E the twist lock elements have been inserted through the second apertures 32 of corner portions 3 of adjacent roof elements 100.

As can be seen in FIGS. 8A-8C, a left portion of the far left roof element 100 of the shelter 200 comprising an assembly of foldable roof elements 100, is connected to an ISO corner casting 21 of a container 20, while the assembly of the roof elements 100 are supported by supporting columns 40 and beams 9 extending between the supporting columns 40.

FIG. 8A shows the roof 100 of the shelter 200 in a partly folded configuration. FIG. 8C shows the roof of the shelter 200 in a fully extended configuration supported by frame elements 9 secured to supporting columns 40. At least some of the roof elements 100 may be secured to the supporting columns 40 by means of double ended twistlocks 20, or by means of bolts as discussed above, or a combination thereof.

In the examples described above, large shelters 200 may be provided by employing several roof elements 100, or by placing another set of roof elements next to the first set. The sets can then be arranged with the short sides 5 of the roof elements 100 of one set adjacent the short sides 5 of the other set.

The roof elements 100 may also be used to provide a mezzanine for storage of goods on top of a roof element 100 inside of an existing warehouse.

From the disclosure herein, it should be appreciated that the roof element 100 according to the invention may be made from a roof element manufactured for an ISO freight container, but wherein the corner portion 3 of the roof elements 100 are made from the ISO corner castings arranged upside down. Thus, the roof element 100 is made from standard components. In embodiments of the invention, the ISO corner castings 3 have been modified by providing an additional aperture 32 opposite of and coaxial with the first aperture 31 provided by the manufacturer of the ISO corner castings. Thus, a single corner portion 3 may be adapted for multiple uses, instead of providing a prior art assembly of two ISO corner casting being mirrored with respect to each other.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A roof element resembling a standard roof element of an International Organization for Standardization (ISO) freight container, the roof element comprising:

a first face for, in a position of use, forming a downwardly facing surface of the roof element;

a second face opposite the first face; and four hexahedron ISO corner portions, wherein each of the four hexahedron ISO corner portions comprises a first aperture configured for receiving a twistlock element, wherein the first aperture is arranged in a support face of the respective hexahedron ISO corner portion, the support face being closer to the first face than the second face, and wherein the support face of at least one of the four hexahedron ISO corner portions further comprises at least two threaded bolt holes.

2. The roof element according to claim 1, wherein each of the four hexahedron ISO corner portions is made from an ISO 1161 corner casting.

3. The roof element according to claim 2, wherein at least at least one of the four hexahedron ISO corner portions is provided with a second aperture configured for receiving a twistlock element, the second aperture being arranged in a face of the hexahedron ISO corner portion that is opposite the support face comprising the first aperture.

4. The roof element according to claim 1, wherein at least one of the four hexahedron ISO corner portions is provided with a second aperture configured for receiving a twistlock element, wherein the second aperture is arranged in a face of a hexahedron ISO corner portion of the four hexahedron ISO corner portions that is opposite the support face comprising the first aperture.

5. A stack of two or more roof elements according to claim 4, the stack further comprising at least one twistlock element arranged in opposing first and second apertures of two abutting roof elements.

6. A shelter comprising at least one roof element according to claim 1, and a support for carrying the roof element in an elevated position.

7. The shelter according to claim 6, wherein the support is connected to the roof element via the first aperture of at least one of the four hexahedron ISO corner portions.

8. The shelter according to claim 6, wherein the roof element is configured to be connected to the support via an aperture arranged in a side portion of the at least one of the four hexahedron ISO corner portions.

9. The shelter according to claim 6, wherein the support face of at least one of the four hexahedron ISO corner portions further comprises at least two threaded bolt holes, and wherein the support is connected to the roof element by threaded bolts in engagement with the threaded bolt holes.

10. The shelter according to claim 6, further comprising at least two roof elements hingedly interconnected by hinged brackets.

11. The shelter according to claim 10, wherein each hinged bracket comprises:

a first hinge portion comprising a twistlock element; and a second hinge portion comprising a twistlock element;

wherein the first hinge portion is pivotable with respect to the second hinge portion, and wherein the twistlock elements of the hinged bracket connecting abutting roof elements are in engagement with either a first aperture or a second aperture of at least one of the four hexahedron ISO corner portions of the roof elements.

12. A stack of two or more roof elements according to claim 1, the stack further comprising at least one twistlock element arranged in opposing first and second apertures of two abutting roof elements.

13. A roof element resembling a standard roof element of an International Organization for Standardization (ISO) freight container, the roof element comprising:

a first face for, in a position of use, forming a downwardly facing surface of the roof element;

a second face opposite the first face; and four hexahedron ISO corner portions, wherein each of the four hexahedron ISO corner portions comprises a first aperture configured for receiving a twistlock element, wherein the first aperture is arranged in a support face of the respective hexahedron ISO corner portion, the support face being closer to the first face than the second face, and wherein at least one of the four hexahedron ISO corner portions is provided with a second aperture configured for receiving a twistlock element, wherein the second aperture is arranged in a face of a hexahedron ISO corner portion of the four hexahedron ISO corner portions that is opposite the support face comprising the first aperture.

14. A shelter comprising:

at least one roof element resembling a standard roof element of an International Organization for Standardization (ISO) freight container, the roof element comprising:

a first face for, in a position of use, forming a downwardly facing surface of the roof element;

a second face opposite the first face; and four hexahedron ISO corner portions, wherein each of the four hexahedron ISO corner portions comprises a first aperture configured for receiving a twistlock element, and wherein the first aperture is arranged in a support face of the respective hexahedron ISO corner portion, the support face being closer to the first face than the second face; and a support for carrying the roof element in an elevated position, wherein the roof element is configured to be connected to the support via an aperture arranged in a side portion of the at least one of the four hexahedron ISO corner portions.

15. A roof element resembling a standard roof element of an International Organization for Standardization (ISO) freight container, the roof element comprising:

a first face for, in a position of use, forming a downwardly facing surface of the roof element;

a second face opposite the first face; and four hexahedron ISO corner portions, wherein each of the four hexahedron ISO corner portions comprises a first aperture configured for receiving a twistlock element, wherein the first aperture is arranged in a support face of the respective hexahedron ISO corner portion, the support face being closer to the first face than the second face, wherein each of the four hexahedron ISO corner portions is made from an ISO 1161 corner casting, and wherein at least one of the four hexahedron ISO corner portions is provided with a second aperture configured for receiving a twistlock element, the second aperture being arranged in a face of the hexahedron ISO corner portion that is opposite the support face comprising the first aperture.

* * * * *